United States Patent [19]

Daniel

[11] 4,047,515

[45] Sept. 13, 1977

[54] WOOD BURNING FURNACE

[76] Inventor: Walter Lee Daniel, P.O. Box 1154, Harrison, Ark. 72601

[21] Appl. No.: 649,748

[22] Filed: Jan. 16, 1976

[51] Int. Cl.[2] ..... F24H 3/06

[52] U.S. Cl. ..... 126/110 R; 110/8 A; 110/75 B; 126/67; 292/DIG. 49; 432/72

[58] Field of Search ..... 126/110 R, 110 B, 60, 126/61, 65, 66, 67, 83, 69, 103; 110/75 R, 75 B, 8 A; 432/72; 236/1 G; 292/DIG. 49, DIG. 53, DIG. 60

[56] References Cited

U.S. PATENT DOCUMENTS

| | | | |
|---|---|---|---|
| 921,019 | 5/1909 | Speer | 126/83 X |
| 1,719,500 | 7/1929 | Breese, Jr. | 126/67 |
| 2,475,120 | 7/1949 | Young | 126/83 X |
| 3,044,460 | 7/1962 | Moskinson | 126/110 B |
| 3,051,100 | 8/1962 | Singleton | 110/8 A |
| 3,171,399 | 3/1965 | Kirgan | 126/110 B |
| 3,675,600 | 7/1972 | Jones | 118/8 A X |

*Primary Examiner*—William E. Wayner
*Assistant Examiner*—William E. Tapolcai, Jr.

[57] ABSTRACT

A unitary firebox enclosed by a cabinet through which air is circulated for heating purposes. A blower forces air into the interior of the firebox through louvers located on the opposite side walls at a level adjacent the fire. Secondary air is drawn into a secondary combustion chamber to assist in complete combustion of the gases. A hinged door for the firedoor is held closed by a toggle latching arrangement, and the door is adjustable in order to assure a tight seal even if warpage should occur. A bypass damper may be opened to assure that smoke and ash are drawn into the flue instead of drifting out through the firebox door during the loading of fuel.

7 Claims, 8 Drawing Figures

Fig. 5.
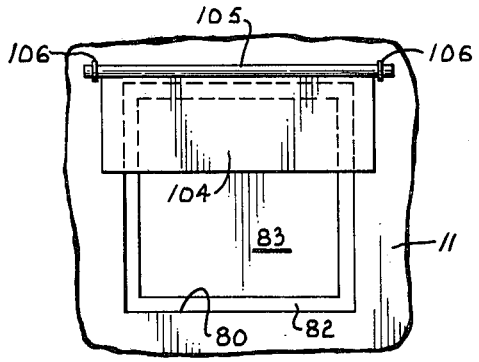
Fig. 6.
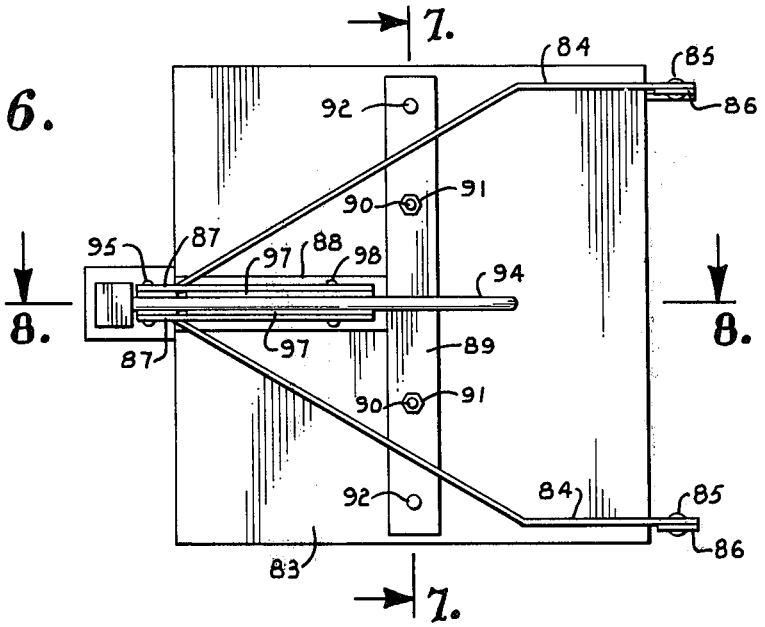
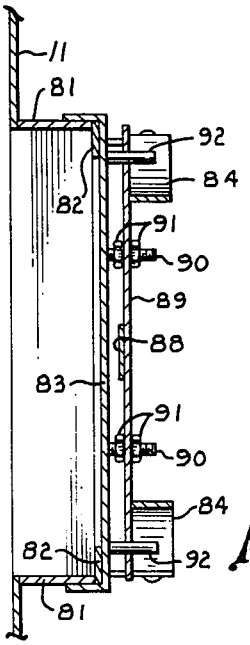
Fig. 7.
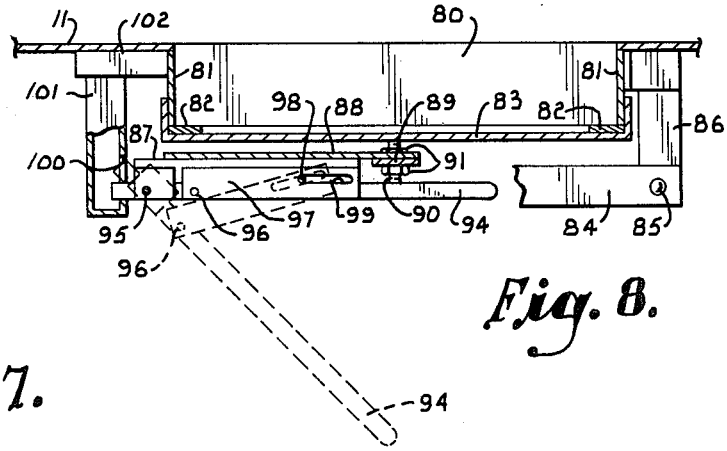
Fig. 8.

WOOD BURNING FURNACE

BACKGROUND AND SUMMARY OF THE INVENTION

This invention relates generally to furnaces and more particularly to hot air furnaces that are adapted to burn wood.

One of the major problems with conventional wood burning furnaces has been the tendency for an extremely hot fire to develop. This is attributed primarily to the manner in which combustion air is supplied to the firebox. Typically air is introduced beneath the grates on which the wood is supported and thus flows upwardly through the center of the fire to cause a hotter fire than is necessary or desirable. Consequently, excessive wood is consumed and the extreme heat causes the grates to become warped.

Incomplete combustion has been another problem associated with conventional wood burning furnaces. The resultant inefficiency of the combustion process increases the amount of fuel required to maintain adequate heating and is further undesirable from an air pollution standpoint. It is also common for smoke and ash to escape from the furnace when the door is open to replenish the wood supply. Additional leakage occurs because of the manner in which conventional furnaces are constructed. The furnace is usually formed from a plurality of separate sections which are field assembled and caulked with furnace cement or the like at the seams. The cement eventually dries out or otherwise develops leaks, and smoke is thus permitted to escape into the heated areas.

A need therefore remains for an improved furnace which is able to effect efficient combustion with a relatively low temperature fire and without significant smoke leakage. It is the primary object of the present invention to meet this need.

More specifically, it is an object of this invention to provide a furnace which supplies controlled amounts of air for combustion above and to the sides of the fire in order to prevent an excessively hot fire from developing.

Another object of this invention is to provide a furnace of the character described which includes a secondary air intake for assisting in complete combustion prior to the passage of the gases out of the flue.

Still another object of the invention is to provide a furnace of the character described that includes a firebox of unitary construction in order to eliminate the possibility of smoke leakage.

A further object of the invention is to provide a furnace of the character described which includes a bypass damper to channel smoke directly into the flue when the main door of the firebox is opened.

An additional object of the invention is to provide a furnace of the character described that requires less maintenance as compared to conventional furnaces.

Yet another object of the invention is to provide a furnace of the character described in which the heat transfer from the firebox to the circulating air is increased in efficiency as compared to conventional furnaces.

A still further object of the invention is to provide a furnace of the character described that has improved controls for maintaining a uniform temperature and conserving fuel.

Other and further objects of the invention, together with the features of novelty appurtenant thereto, will appear in the course of the following description of the drawings.

DETAILED DESCRIPTION OF THE INVENTION

In the accompanying drawings which form a part of the specification and are to be read in conjunction therewith, and in which like reference numerals are employed to indicate like parts in the various views:

FIG. 5 is a fragmentary elevational view taken generally along line 5—5 of FIG. 2 in the direction of the arrows;

FIG. 6 is a fragmentary front elevational view on an enlarged scale showing the firebox door in its closed position;

FIG. 7 is a cross sectional view taken generally along line 7—7 of FIG. 6 in the direction of the arrows; and FIG. 8 is a cross sectional view taken generally along line 8—8 of FIG. 6 in the direction of the arrows, with portions broken away for clarity and the broken lines indicating the door latch moved to its release position to permit opening of the door.

Figure 1:
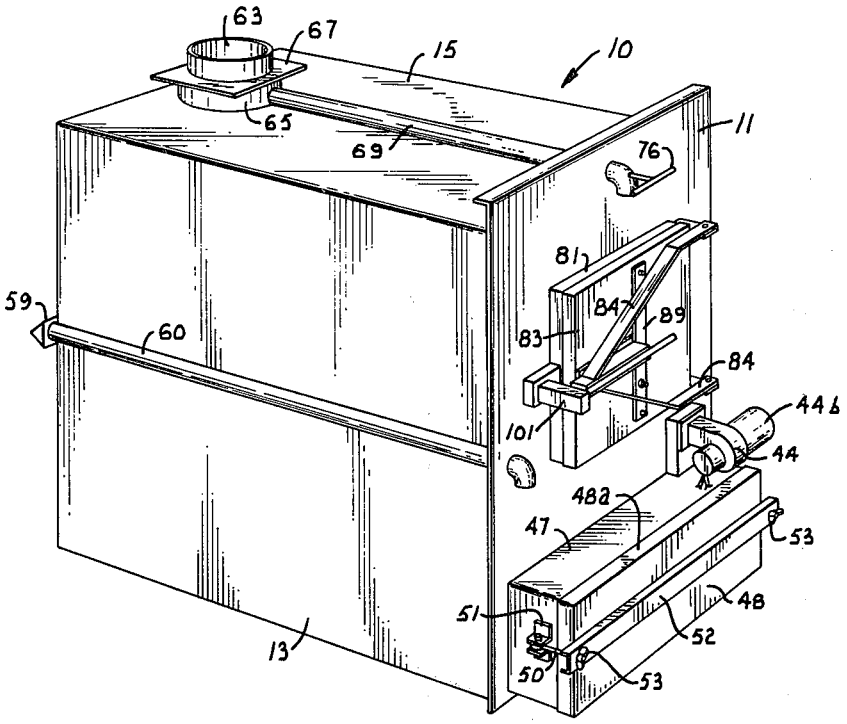
FIG. 1 is a perspective view illustrating a firebox constructed in accordance with the present invention.
Figure 2:
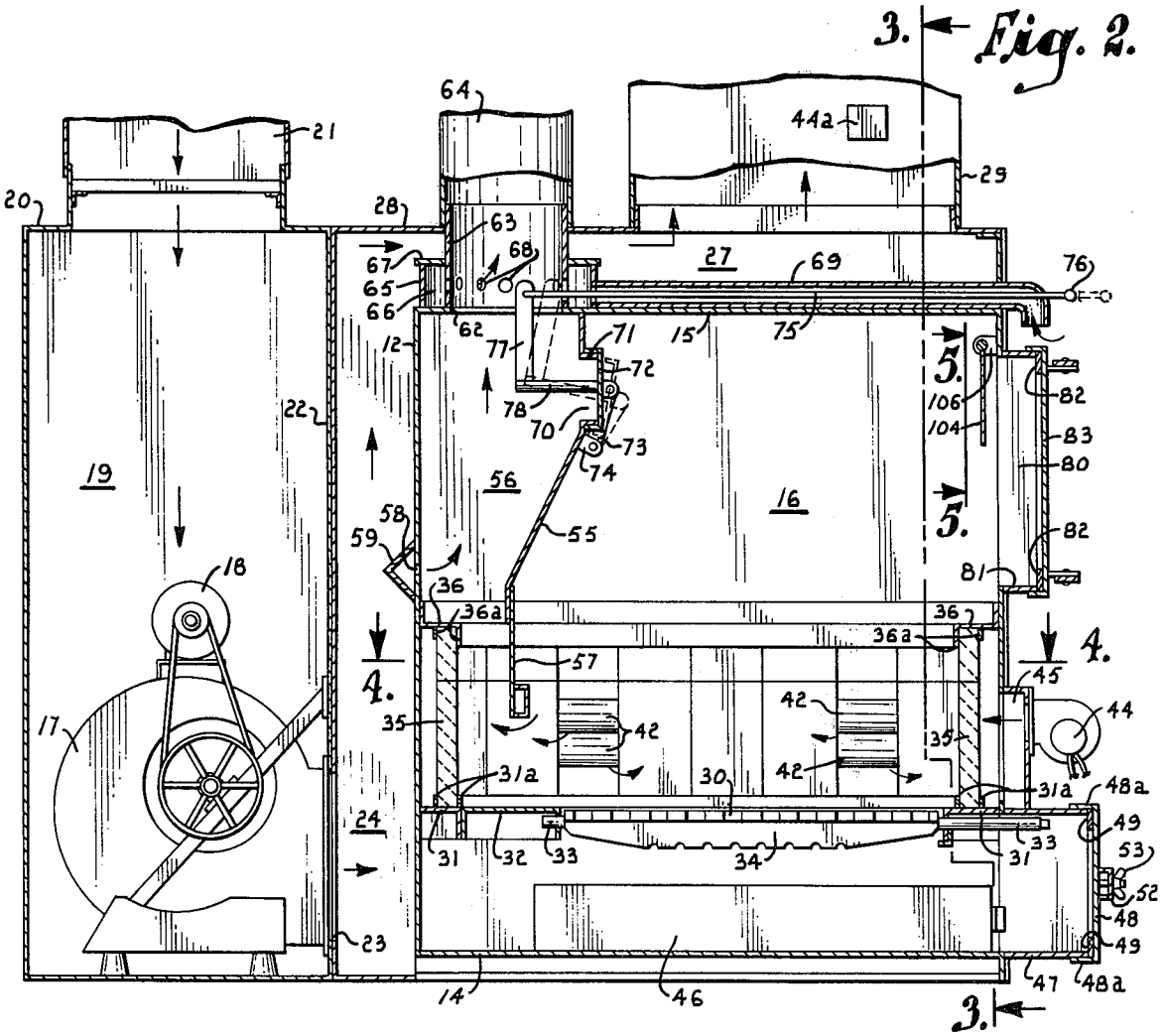
FIG. 2 is a side elevational view in cross section illustrating a furnace in which the firebox shown in FIG. 1 is installed, the broken lines indicating movement of the bypass damper to an open position and the directional arrows indicating the path of air and combustion gases within the furnace.

Referring now to the drawings in detail and initially to FIGS. 1 and 2, a firebox constructed according to the present invention is generally designated by reference numeral 10. The firebox has front and rear walls 11 and 12, opposite side walls 13, a floor 14, and a ceiling 15, all of which are metal panels welded together in a unitary construction. The interior of firebox 10 presents an enclosed combustion chamber 16 in which the fuel is burned and from which leakage is prevented due to the unitary, all welded construction. The heat generated within firebox 10 is transferred to air which is circulated through the cabinet that surrounds the firebox. With reference to FIG. 2, a main blower unit 17 is driven by a motor 18, both of which are housed within a compartment 19 located to the rear of the firebox. A roof panel 20 of compartment 19 is provided with a return air duct 21 through which air is drawn by blower 17. A front wall 22 of compartment 19 has an outlet 23 near its lower end through which the air is passed by the blower.

A duct 24 is presented between wall 22 and the rear wall 12 of the firebox to receive the air that passes through outlet 23. Side ducts 25 (FIG. 3) are presented between the side walls 13 of the firebox and exterior wall panels 26 of the furnace. Duct 24 and the side ducts 25 communicate with each other and with an upper duct 27 which lies above the firebox ceiling 15 and below a roof panel 28 of the furnace. An outlet duct 29 extends through roof 28 from duct 27 and leads to registers or the like (not shown) which distribute the warm air to the various rooms that are to be heated. Ducts 24, 25 and 27 are all located adjacent to the firebox so that efficient heat transfer to the circulating air is achieved.

Figure 4:
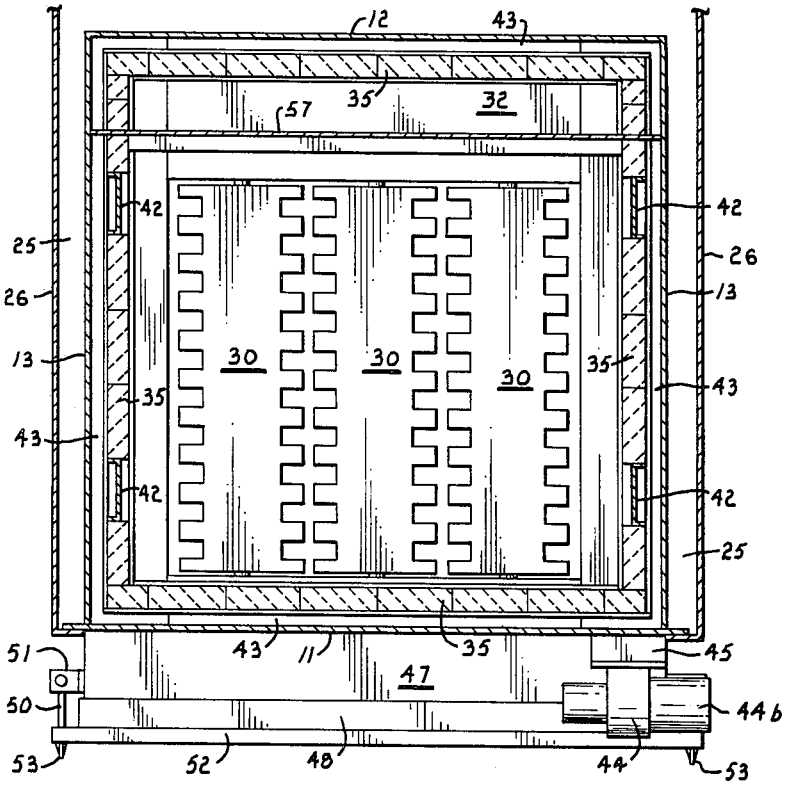
FIG. 4 is a sectional view taken generally along line 4—4 of FIG. 3 in the direction of the arrows.

Referring now more particularly to the details of firebox 10, a plurality of cast iron grates 30 for supporting wood are mounted a spaced distance above floor 14. Angle members 31 (FIG. 2) are secured to the front and rear walls of the firebox to extend therealong at an elevation above the floor. A channel 32 is secured to the rear angle member 31. The flanges of the front angle member 31 and channel 32 are oriented vertically and are apertured in order to receive stub extensions 33 on the opposite ends of grates 30. The grates are thus supported to extend parallel to one another from front to rear within the firebox. As best shown in FIG. 4, each grate 30 is notched at spaced locations along both sides so that ashes are able to drop through the notches. A notched rib 34 (FIG. 2) tapered at each end extends longitudinally along the underside of each grate for strengthening purposes and to reduce the possibility of warpage.

The walls of the firebox in the area of grate 30 are lined with fire brick 35 which extends completely around the firebox a spaced distance inwardly of the walls thereof. The fire brick that lines the front and rear firebox walls is supported on top of angle members 31 and is retained in place by small flanges 31*a* between which the fire brick is received. Upper angle members 36 are secured to the front and rear walls of the firebox and are which receive the top end of the fire brick to assist in maintaining it in place.

Figure 3:
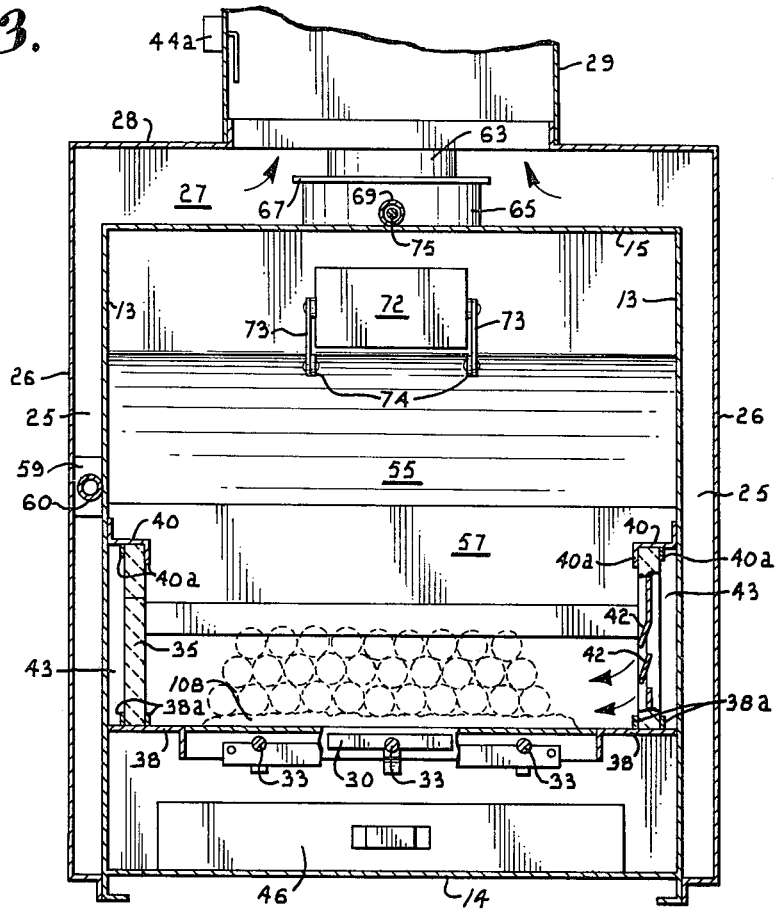
FIG. 3 is a sectional view taken generally along line 3—3 of FIG. 2 in the direction of the arrows.

With reference to FIG. 3, the fire brick 35 that lines the side walls of the firebox is supported on top of angle members 38 which are secured to walls 13 and provided with flanges 38*a* between which the fire brick is received and retained. Upper angle members 40 are secured to walls 13 and provided with flanges 40*a* which receive the top end of the fire brick. The fire brick 35 preferably extends from the approximate level of grates 30 to a position well above the level at which wood is normally stacked on the grates.

The fire brick that lines the side walls 13 is provided with cast iron draft louvers 42 which present inlet air slits through each of the fire brick side walls. There are preferably two sets of louvers 42 on each side wall located near the front and rear portions thereof, as best shown in FIG. 4. Each set of louvers 42 presents a pair of inlet slits, and the louvers slope downwardly and inwardly in order to direct the inlet air toward the fire on opposite sides thereof. Each louver 42 is located at a level above that of grates 30, while the fire brick and the walls of the firebox are imperforate below the grates. It has been found that louvers on the side walls of fire brick are able to supply adequate air to the fire and that the air is more easily controlled than if additional air inlets were provided in the front and rear walls.

Air passages 43 communicate with louvers 42 to supply air to the inlet slits. As best shown in FIG. 4, the passages 43 are presented between the firebox walls and the fire brick 35, and the passages extend completely around the fire brick to define a closed, endless path. Accordingly, the air that passes through passages 43 is preheated prior to discharging through the inlet slits of louvers 42. A fan or blower 44 is mounted exteriorly of the firebox on the front wall 11. The blower draws in ambient air and discharges it through an inlet 45 to passages 43. It is noted that since passages 43 present a closed path, the air pressure is substantially uniform within the passage so that equal amounts of air are discharged through each of the louvers 42.

Both the main blower 17 and the draft blower 44 are controlled primarily by a conventional room thermostat (not shown) which turns each of the blowers on when the room temperature drops below a preselected level. In addition, a limit switch 44*a* further serves to control the operation of blower 44. Limit switch 44*a* is mounted in the outlet duct 29 and has a set of normally closed contacts which open when the temperature in the circulation duct 29 reaches a preselected temperature, preferably about 150° F. The opening of the contacts activates a conventional barometric damper 44*b* (FIGS. 1 and 4) which restricts the air intake of blower 44 and permits only enough air into the firebox to maintain the fire. The limit switch and damper thereby act to keep the temperature of the fire and the circulating air below a preselected temperature level, which conserves fuel and eliminates significant temperature fluctuations of the firebox itself and of the warmed circulation air. The limit switch 44*a* for blower 44 also provides an override in the event of a malfunction in the thermostat.

An ash pan 46 rests on the floor 14 of the firebox to receive the ashes that fall through the grates 30. A rectangular box structure 47 on the lower portion of the front firebox wall 11 is provided with a door 48 which provides access to the ash pan 46. Door 48 has flanges 48*a* bent rearwardly from its periphery at a right angle in order to fit closely around box 47. Asbestos gaskets 49 (FIG. 2) are mounted around the forward edges of box 47 to tightly seal against the door. Elongate bolts 50 are mounted to extend forwardly from brackets 51 which are secured to the opposite sides of box 47. A channel 52 is secured to the forward surface of door 48 and projects beyond the opposite ends thereof in order to receive the bolts 50. Wing nuts 53 are tightened down on bolts 50 and against channel 52 to maintain door 48 tightly closed against gaskets 49, even if the door should become warped.

With reference to FIG. 2 in particular, an interior panel 55 is secured to extend between the firebox side walls 13 at a location spaced forwardly of the rear wall 12. Panel 55 and wall 12 present a chamber 56 therebetween which serves as a secondary combustion chamber. Panel 55 extends from the firebox ceiling 15 and includes a lower portion which slopes downwardly and to the rear, terminating at the approximate level of the top end of the fire brick 35. A baffle 57 is secured to the lower end of panel 55 to form a downward continuation thereof. The lower end of baffle 57 is located intermediate the height of fire brick 35, and an inlet to chamber 56 from the primary combustion chamber 16 is presented beneath the bottom of the baffle 57.

A secondary air intake port 58 is formed through the rear wall 12 of the firebox to supply air to chamber 56. A triangular manifold 59 is secured along wall 12 in order to supply air to port 58. A pipe 60 (FIG. 1) connects to the end of manifold 59 to supply air thereto. Pipe 60 is mounted to extend along one of the firebox side walls 13. The forward or inlet end of pipe 60 is located forwardly of the front wall 11 and is bent downwardly. Air is drawn into the bent inlet end of pipe 60, passed into manifold 59, and from there into the secondary combustion chamber 56 through port 58.

A flue opening 62 is formed through the ceiling 15 at a location above chamber 56. A short cylindrical conduit 63 is secured to extend upwardly from the roof to receive the gases discharging into the flue opening.

Near its top end, conduit 63 is tightly secured within a flue conduit 64 which extends from roof 28 to exhaust the flue gases from the furnace. Near its lower end, conduit 63 is surrounded by a somewhat larger conduit 65 so that an annular air chamber 66 is presented in the area between conduits 63 and 65. A cover plate 67 is secured to cover the top of chamber 66, while a plurality of apertures 68 are formed through the wall of conduit 63 to provide passages that connect chamber 66 with the interior of the flue. An elongate pipe 69 extends along ceiling 12 to supply air to chamber 66. The forward or inlet end of pipe 69 is bent downwardly at a location forwardly of the front wall 11. Supplemental air is drawn into pipe 69, passed into chamber 66, and through openings 68 into the flue where it is mixed with the flue gases.

A bypass opening 70 is formed through the upper or vertical portion of panel 55 near ceiling 15 to admit smoke directly into chamber 56 from the primary combustion chamber 16. Flanges 71 extend forwardly from panel 55 around opening 70. A pivotal bypass damper 72 is flanged at its edges in order to fit closely with flanges 71. As best shown in FIG. 3, opening 70 and damper 72 are substantially centrally located along the width of panel 55. Damper 72 is pivotally supported at its opposite ends by a pair of levers 73 which are pinned to the damper at their top ends. The lower ends of levers 73 are pivotally pinned to ear plates 74 which project from panel 55.

An elongate control rod 75 serves to move damper 72 between its open and closed positions. Rod 75 is supported to extend longitudinally within pipe 69 for axial sliding therein. The forward end of rod 75 projects through pipe 69 and is equipped with a handle 76. The rearward end of rod 75 extends into conduit 63 where it is pivoted to the top end of link 77. Another link 78 is secured to extend forwardly from the lower end of link 77, and the forward end of link 78 is pivoted to damper 72. Forward pulling of rod 75 by its handle pulls link 77 forwardly and pivots it such that the lower link 78 pushes damper 72 away from opening 70 to the open position shown in broken lines in FIG. 2. Pushing of rod 75 to the rear pushes link 77 rearwardly and pivots link 78 in a manner to pull damper 72 closed over opening 70, as shown in solid lines in FIG. 2.

An opening 80 (FIG. 2) is formed in the front wall 11 of the firebox in order to permit the wood supply to be replenished. Flanges 81 extend forwardly from wall 11 around the perimeter of opening 80. Asbestos gaskets 82 are secured to closure door 83 to form a tight seal with flanges 81.

FIGS. 6–8 illustrate the details of door 83 and the manner in which it is hingedly mounted on the front wall 11. A pair of hinge arms 84 are pivotally pinned at 85 to mounting brackets 86 which extend from wall 11. Arms 84 are bent to converge as they extend away from brackets 86. A pair of horizontal plates 87 are secured to the extreme ends of arms 84 and are spaced vertically from one another. Plates 87 are welded at their edges to a mounting plate 88 which is secured at one end to a metal strap 89 on which door 83 is adjustably supported.

Referring now to FIG. 7 in particular, a pair of threaded studs 90 extend outwardly from door 83 and are fit through apertures in strap 89. A pair of nuts 91 are tightened on each stud 90 against the opposite sides of strap 89 in order to lock door 83 in position relative to the strap. Additional studs 92 extend from door 83 through apertures in strap 89 to assist in maintaining the strap and door in relative position.

A toggle type latching arrangement is provided to lock door 83 in its closed position over opening 80. An elongate handle 94 is pivoted near one end between plates 87 by a pivot pin 95. Another pivot pin 96 offset from pin 95 pivotally connects handle 94 between a pair of plates 97 which fit between plates 87. A pin 98 extends between plates 87 and is received in slots 99 which are formed in plates 97, plates 87 thereby being able to slide and pivot relative to plates 97.

As shown in FIG. 8, the left or latching end of handle 94 fits within an opening 100 that is formed in a latch 101. Latch 101 comprises a hollow bar member that extends forwardly from a mounting block 102 which is secured to wall 11 at a location to the side of opening 80. When the toggle is straightened out as shown in solid lines in FIG. 8, it tends to remain in its rigidly straight condition, and handle 94 is firmly retained in opening 100 to hold door 83 closed. When the free end of handle 94 is pulled outwardly, the handle pivots about pin 95 which pulls pin 96 outwardly and causes plates 97 to pivot and slide relative to pin 98. This causes the toggle to become bent as shown in broken lines in FIG. 8 and permits withdrawal of handle 94 from opening 100 upon sufficient outward pulling of the handle. After the latch is thus released, further pulling of handle 94 pivots the entire door and hinge structure outwardly about pins 85. When the door is swung closed, the free end of the handle 94 is pushed inwardly until the toggle straightens out and thereafter remains straight to secure the door in its closed position.

The spacing of door 83 from strap 89 may be easily adjusted due to the adjustable connection provided by studs 90. Since strap 89 is always in the same position relative to the firebox when the door latch is closed, outward movement of the strap on the studs 90 actually has the effect of moving door 83 inwardly such that it will tightly close opening 80 even if it is warped or as the asbestos gasket 82 wears.

FIGS. 2 and 5 illustrate a pivotal baffle 104 that is supported within the firebox near opening 80. The baffle is suspended from a rod 105 that is pivotally supported at its opposite ends on brackets 106 which extend from wall 11 at a location directly above opening 80. Baffle 104 extends downwardly approximately half the height of opening 80 in order to assist in preventing smoke and ash from drifting out of the firebox through opening 80 when the door 83 is opened.

In use, the heat generated from wood burning on grates 30 is transferred from the firebox to the air that is being circulated in ducts 24, 25 and 27 by the main blower 17. The directional arrows in FIG. 2 indicate the path that is taken by the circulating air. The heated air passes out of the furnace through duct 29 and is distributed to the rooms through conventional registers or the like.

Blower 44 acts to supply air to the firebox through louvers 42, which direct the air downwardly and inwardly toward the fire on opposite sides thereof. The fire is thus prevented from becoming excessively hot as is the case in furnaces in which the air is introduced upwardly through the fire. Louvers 42 additionally serve to control the quantity of air that is supplied to the fire due to the thin inlet air slits that are presented in only the sides of the fire brick 35. It is contemplated that a bed of ash approximately 4 inches in thickness will be maintained on top of grates 30. This ash bed is indicated at 108 in FIG. 3 and further provides insulating protection for the grates 30. When the level of the ash reaches the lower louvers 42, at least some of the ash should be removed.

Blower 44 supplies sufficient air to the firebox to maintain the fire at the desired temperature level but prevents the fire from becoming excessively hot and thus consuming a large amount of wood. Blowers 17 and 44 are controlled primarily by a conventional room thermostat while the limit switch 44*a* controls the fire temperature as described previously and assures that the circulating air will not become overly hot. If the temperature in the outlet ductwork 29 exceeds 150°, the intake of blower 44 is restricted by the limit switch in a manner such that the blower will supply only enough air to maintain the fire. When the air temperature in the ductwork 29 eventually drops below 150°, the limit switch allows blower 44 to resume its full capacity operation.

The secondary intake port 58 supplies air to the secondary combustion chamber 56 in order that the gases will be substantially burned prior to exhausting through the flue. The path of the combustion gases is ordinarily beneath the edge of baffle 57 as indicated by the directional arrow in FIG. 2. The draft of the gases flowing upwardly through chamber 56 and out the flue 64 draws the secondary air in through port 58, and the secondary air effects further combustion of the gases. The additional heat developed in Chamber 56 is transferred to the surrounding ductwork, and the heating efficiency of the furnace is increased accordingly. The flue gas draft also pulls supplemental air in through apertures 68 to supply still further air to the flue gases so that clean gases pass through the flue.

The unitary construction of the firebox eliminates all field joints which require caulking or cementing. The only potential leakage is through the main door 83 or the ash pit door 48, both of which are sealed with gasket material. Prior to opening the main door 83 for adding wood or door 48 for removing ash, the control rod 75 may be pulled outwardly to open damper 72. When door 83 is thereafter opened, the upward draft of the gases in chamber 56 draws smoke and ash through the damper opening 70. Consequently, the smoke and ash pass directly into chamber 56 instead of drifting out through the open door. The baffle 104 cooperates with the bypass damper arrangement in preventing smoke from escaping from the firebox in any appreciable quantity.

From the foregoing it will be seen that this invention is one well adapted to attain all ends and objects hereinabove set forth together with the other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. A firebox for a wood burning furnace, said firebox comprising:

a plurality of walls, a floor, and a ceiling integrally joined together to provide a substantially enclosed primary combustion chamber;

a fuel support frame located within said primary combustion chamber for supporting fuel therewithin;

a plurality of air inlet openings into said primary combustion chamber at a level above said fuel support frame, said inlet openings being oriented and arranged to direct air passing therethrough generally downwardly and inwardly within said primary combustion chamber toward the fuel on said fuel support;

a blower operable to force air through said inlet openings for combustion of the fuel;

a secondary combustion chamber communicating with said primary combustion chamber to receive combustion gases;

means presenting a bypass opening communicating said primary and secondary combustion chambers with one another;

a bypass damper supported for movement to open and close said bypass opening;

actuator linkage connected with said bypass damper to open and close same, said linkage including a control member accessible from the exterior of said primary combustion chamber;

a secondary air intake to said secondary combustion chamber for supplying ambient air thereto to effect further burning of the combustion gases; and a flue outlet from said secondary combustion chamber for directing the gases out of the firebox.

2. A firebox as set forth in claim 1, including a fuel supply opening to said primary combustion chamber, a door supported for movement to open and close said supply opening, and a baffle supported within said primary combustion chamber in proximity to said supply opening to restrict the flow of gases theretoward.

3. A firebox for a wood burning furnace, said firebox comprising:

a plurality of walls, a floor, and a ceiling integrally joined together to cooperate in presenting a substantially enclosed firebox compartment;

a partition disposed within said compartment to substantially separate same into a primary and a secondary combustion chamber, said primary and secondary chambers communicating with one another past said partition;

a fuel support frame adapted to support fuel within said primary chamber;

means for supplying air to said primary chamber for combustion of the fuel;

a bypass opening formed through said partition to provide access for gas flow from said primary to said secondary combustion chamber;

a bypass damper supported to open and close said bypass opening;

actuator linkage connected with said damper to effect opening and closing thereof;

a secondary air intake to said secondary combustion chamber for supplying air thereto to effect further burning of the combustion gases, said secondary air intake communicating with an air source; and a flue outlet from said secondary combustion chamber for directing the gases out of the firebox.

4. A firebox as set forth in claim 3, wherein said partition is oriented generally vertically and includes a lower end spaced above said floor to provide communication between said primary and secondary combustion chambers, said bypass opening being formed through said partition at a location in proximity to said ceiling.

5. A furnace comprising:

a firebox presenting a substantially enclosed primary combustion chamber interiorly thereof;

ductwork extending in close proximity to said firebox for receiving air that is to be heated;

means for circulating air through said ductwork;

a plurality of air inlet openings into said primary combustion chamber for supplying air thereto;

a blower operable to force air into said primary combustion chamber through said air inlet openings;

adjustable means associated with said blower for regulating the air flow therefrom;

a switch for controlling the adjustable means of said blower, said switch being located and adapted to sense the temperature within said ductwork and being coupled with said adjustable means to effect restriction of the air flow from said blower when the temperature in the ductwork exceeds a preselected reference temperature;

a secondary combustion chamber communicating with said primary combustion chamber to receive combustion gases;

a secondary air intake to said secondary combustion chamber for supplying air thereto to effect further burning of the combustion gases, said secondary air intake communicating with an air source; and a flue outlet from said secondary combustion chamber for directing the gases out of the firebox.

6. A firebox for a wood burning furnace, said firebox comprising:

a plurality of walls, a floor, and a ceiling integrally joined together to provide a substantially enclosed primary combustion chamber;

a fuel support frame located within said primary combustion chamber for supporting fuel therewithin;

a plurality of air inlet openings into said primary combustion chamber at a level above said fuel support frame, said inlet openings being oriented and arranged to direct air passing therethrough generally downwardly and inwardly within said primary combustion chamber toward the fuel on said fuel support;

a blower operable to force air through said inlet openings for combustion of the fuel;

a secondary combustion chamber communicating with said primary combustion chamber to receive combustion gases;

a secondary air intake to said secondary combustion chamber for supplying ambient air thereto to effect further burning of the combustion gases;

a flue outlet from said secondary combustion chamber for directing the gases out of the firebox;

a supply opening disposed through one wall of said primary combustion chamber for supplying fuel thereto;

a door for opening and closing said supply opening, said door equipped with a gasket to sealingly engage said supply opening;

a hinge structure supporting said door on said one wall for opening and closing movement; and adjustment means for adjusting the position of said door relative to said hinge structure, whereby said door may be adjusted to vary the compression applied to said gasket between said door and supply opening to tightly close said supply opening.

7. A firebox for a wood burning furnace, said firebox comprising:

a plurality of walls, a floor, and a ceiling integrally joined together to provide a substantially enclosed primary combustion chamber;

a fuel support frame located within said primary combustion chamber for supporting fuel therewithin;

a plurality of air inlet openings into said primary combustion chamber at a level above said fuel support frame, said inlet openings being oriented and arranged to direct air passing therethrough generally downwardly and inwardly within said primary combustion chamber toward the fuel on said fuel support;

a blower operable to force air through said inlet openings for combustion of the fuel;

a secondary combustion chamber communicating with said primary combustion chamber to receive combustion gases;

a secondary air intake to said secondary combustion chamber for supplying ambient air thereto to effect further burning of the combustion gases;

a flue outlet from said secondary combustion chamber for directing the gases out of the firebox; and means for supplying supplemental air to said flue outlet at a location above said secondary air intake, said means including a jacket chamber enclosing a portion of said flue outlet, openings in said flue outlet communicating with said jacket chamber, and an air passage to deliver ambient air to said jacket chamber.

* * * * *